US010399833B2

(12) United States Patent
Kochie et al.

(10) Patent No.: US 10,399,833 B2
(45) Date of Patent: Sep. 3, 2019

(54) VEHICLE LIFT ADAPTER SYSTEM

(71) Applicants: Bosch Automotive Service Solutions Inc., Warren, MI (US); Robert Bosch GmbH, Stuttgart (DE)

(72) Inventors: Robert J. Kochie, Dodge Center, MN (US); Robert A. Jensen, Clarks Grove, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 500 days.

(21) Appl. No.: 14/980,604

(22) Filed: Dec. 28, 2015

(65) Prior Publication Data

US 2017/0183207 A1 Jun. 29, 2017

(51) Int. Cl.
*B66F 3/00* (2006.01)
*B66F 7/28* (2006.01)

(52) U.S. Cl.
CPC ..... *B66F 7/28* (2013.01); *B66F 2700/123* (2013.01)

(58) Field of Classification Search
USPC ..... 254/88, 94, 133 R, 134
See application file for complete search history.

(56) References Cited

U.S. PATENT DOCUMENTS 5,988,974 A * 11/1999 Zackovich ..... B60P 3/125 280/402
7,175,159 B1 2/2007 Gomillion
7,278,627 B2 * 10/2007 Jones ..... B66F 7/243 254/88
9,079,753 B2 * 7/2015 Kosjer ..... B66F 7/28
2006/0278855 A1 * 12/2006 Krug ..... B66F 7/02 254/4 B
2010/0283016 A1 11/2010 Drake
(Continued)

FOREIGN PATENT DOCUMENTS

CN 2352497 Y 12/1999
CN 2630189 Y 8/2004
CN 101033052 A 9/2007
(Continued)

OTHER PUBLICATIONS

English Translation of Chinese Office Action corresponding to Chinese Patent Application No. 201611224550.7 (9 pages).

*Primary Examiner* — Joseph J Hail
*Assistant Examiner* — Shantese L McDonald
(74) *Attorney, Agent, or Firm* — Maginot Moore & Beck LLP

(57) ABSTRACT

A vehicle lift adapter system in one embodiment includes a central support bar including a mounting portion configured to be removably mounted on a jack arm of a floor jack, a first outer support arm supported by the central support bar, a first wheel capture base with a first middle portion located between a first and a second base end portion, the first wheel capture base operably connected to the first outer support arm, a first wheel capture arm configured to be supported by the first end portion, and a second wheel capture arm configured to be supported by the second end portion, wherein the first end portion and the second end portion are arranged such that a weight applied to the first wheel capture arm and the second wheel capture arm is substantially centered on the longitudinal axis.

19 Claims, 2 Drawing Sheets

(56) References Cited

U.S. PATENT DOCUMENTS

2014/0084228 A1* 3/2014 Hart ..... B66F 5/04
254/2 B

FOREIGN PATENT DOCUMENTS

| | | | |
|---|---|---|---|
| CN | 201002182 | Y | 1/2008 |
| CN | 201473263 | U | 5/2010 |
| CN | 201495068 | U | 6/2010 |
| CN | 202116229 | U | 1/2012 |
| CN | 102491218 | A | 6/2012 |

* cited by examiner

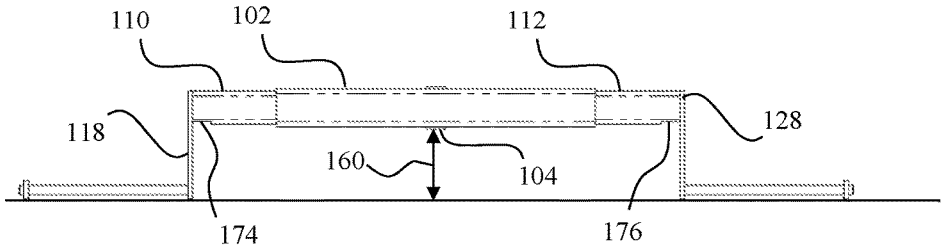
FIG. 2
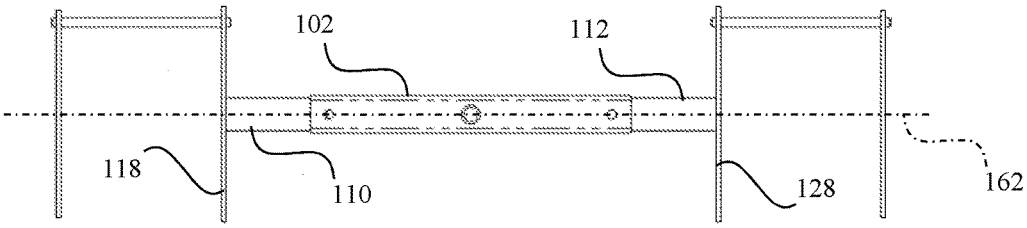
FIG. 3
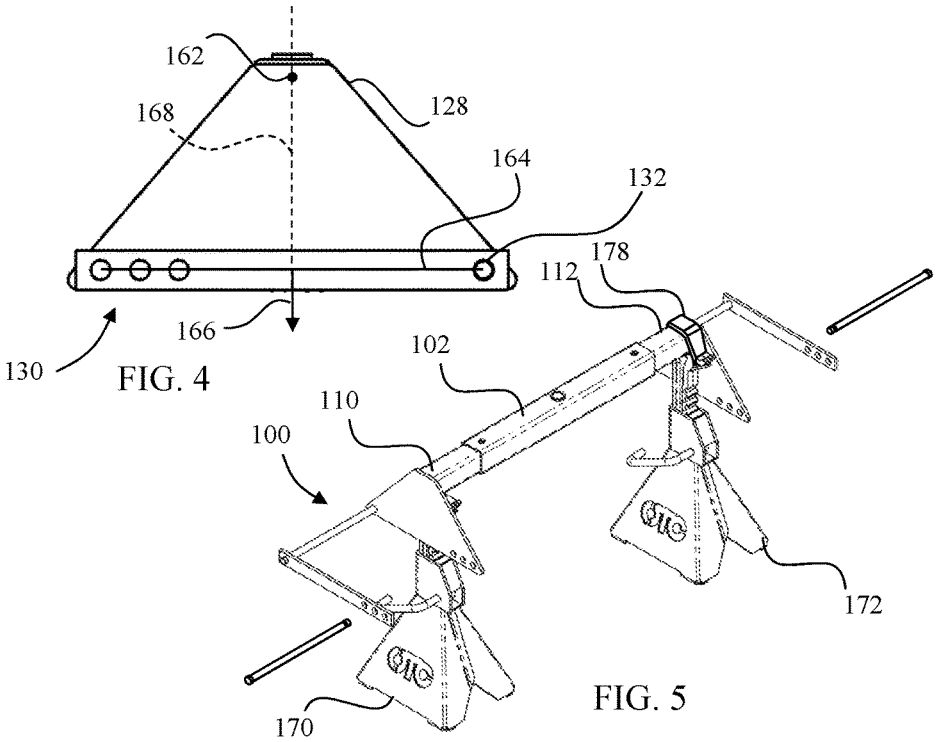
FIG. 4
FIG. 5

VEHICLE LIFT ADAPTER SYSTEM

FIELD

The present disclosure relates to lifting apparatuses, and more particularly, to lifting apparatuses for vehicles such as automobiles, all-terrain vehicles ("ATV"), and the like.

BACKGROUND

Vehicles including automobiles and ATVs require periodic maintenance or other procedures which require the vehicle to be elevated. Professional establishments have vehicle lifts which safely raise a vehicle while supporting the frame of the vehicle. Vehicle owners typically do not have such vehicle lifts at their disposal\al. Nonetheless, owners of the vehicles frequently desire to perform the work themselves. Accordingly, vehicle owners typically use a combination of floor jacks and stands are used.

Floor jacks are very effective at raising a vehicle. The owner must first, however, properly position the jack so as to contact a frame portion of the vehicle. This process is rendered more difficult as many jacks include wheels and the jack tends to move while elevating the jack and prior to contacting the frame. By way of example, U.S. Pat. No. 7,175,159 discloses a floor jack which includes wheels to assist in positioning the floor jack. Accordingly, it is possible for the jack to contact non-load bearing portions of the vehicle thereby damaging the vehicle. Positioning the jack also requires the user to lie on the ground in order to visualize the portion of the frame which is to be used to elevate the vehicle. This task can prove to be inconvenient, particularly when the jack subsequently moves prior to contacting the frame of the vehicle.

Moreover, floor jacks are typically not the most stable of platforms. For example, hydraulic floor jacks can leak, thereby allowing a load to lower during use. Additionally, floor jacks are commonly provided with wheels. The wheels are useful in maneuvering a floor jack into position, but also allow for undesired movement of the jack when a load is elevated.

Accordingly, there is a need for a lift system that overcomes one or more of the shortcomings of known systems. It would be beneficial if the system reduced the potential for applying load to non-load bearing vehicle components. It would be further beneficial if the system provided for securely elevating a vehicle and securely maintaining the vehicle in an elevated position.

SUMMARY

In accordance with one embodiment, a vehicle lift adapter system includes a central support bar including a mounting portion configured to be removably mounted on a jack arm of a floor jack, a first outer support arm supported by the central support bar, a first wheel capture base with a first middle portion located between a first and a second base end portion, the first wheel capture base operably connected to the first outer support arm, a first wheel capture arm configured to be supported by the first end portion, and a second wheel capture arm configured to be supported by the second end portion, wherein the first end portion and the second end portion are arranged such that a weight applied to the first wheel capture arm and the second wheel capture arm is substantially centered on the longitudinal axis.

In one or more embodiments, the first outer support arm is movably supported by the central support bar.

In one or more embodiments, a vehicle lift adapter system includes a first wheel capture endplate, wherein a first end portion of the first wheel capture arm is configured to be supported by the first base end portion, a second end portion of the first wheel capture arm is configured to be supported by the first wheel capture endplate, a third end portion of the second wheel capture arm is configured to be supported by the second base end portion, and a fourth end portion of the second wheel capture arm is configured to be supported by the first wheel capture endplate.

In one or more embodiments, the second base end portion includes a plurality of first mounting holes, the first wheel capture endplate includes a plurality of second mounting holes, each of the plurality of first mounting holes is associated with a respective one of the plurality of second mounting holes, and the second wheel capture arm is configured to be removably supported by a selected one of the plurality of first mounting holes and the respective one of the plurality of second mounting holes.

In one or more embodiments, the first base end portion includes a plurality of third mounting holes, the first wheel capture endplate includes a plurality of fourth mounting holes, each of the plurality of third mounting holes is associated with a respective one of the plurality of fourth mounting holes, and the first wheel capture arm is configured to be removably supported by a selected one of the plurality of third mounting holes and the respective one of the plurality of fourth mounting holes.

In one or more embodiments, a vehicle lift adapter system includes a second outer support arm movably supported by the central support bar, a second wheel capture base with a second middle portion located between a third and a fourth base end portion, the second middle portion operably connected to the second outer support arm, a third wheel capture arm configured to be supported by the third end portion, a fourth wheel capture arm configured to be supported by the fourth end portion; and a first wheel capture endplate, wherein a fifth end portion of the third wheel capture arm is configured to be supported by the third base end portion, a sixth end portion of the third wheel capture arm is configured to be supported by the second wheel capture endplate, a seventh end portion of the fourth wheel capture arm is configured to be supported by the fourth base end portion, and an eighth end portion of the fourth wheel capture arm is configured to be supported by the second wheel capture endplate.

In one or more embodiments, the first and second wheel capture bases are configured such that when the first and second wheel capture base are positioned on a floor, the central support arm is elevated above the floor by a distance which is greater than a minimum height of the jack arm of a floor jack such that the jack arm of the floor jack can be inserted beneath the central support arm without raising the central support arm.

In one or more embodiments, the first and second wheel capture bases are configured such that when the first and second wheel capture base are positioned on the floor, the central support arm is elevated above the floor by a distance of about 3.5 inches.

In one or more embodiments, a vehicle lift adapter system includes at least one coupling mechanism configured to removably couple at least one jack stand to at least one of the central support arm and the first outer support arm.

In one or more embodiments, a vehicle lift adapter system includes at least one jack stand configured to removably support at least one of the central support arm and the first outer support arm.

In one or more embodiments, the at least one jack stand is a ratcheting jack stand.

In accordance with one embodiment, a method of making a vehicle lift adapter system includes configuring a mounting portion of a central support bar to be removably mounted on a jack arm of a floor jack, supporting a first outer support arm with the central support bar, operably connecting a first middle portion of a first wheel capture base with to the first outer support arm, the first middle portion located between a first and a second base end portion, supporting a first wheel capture arm with the first end portion, and providing a second wheel capture arm configured to be supported by the second end portion, wherein the first end portion and the second end portion are arranged such that a weight applied to the first wheel capture arm and the second wheel capture arm is substantially centered on a longitudinal axis defined by the central support arm.

In one or more embodiments, supporting the first outer support arm includes movably supporting the first outer support arm.

In one or more embodiments, supporting the first wheel capture arm includes supporting a first end portion of the first wheel capture arm with the first base end portion, and the method further includes supporting a first wheel capture endplate with a second end portion of the first wheel capture arm, wherein the second wheel capture arm includes a third end portion configured to be supported by the second base end portion, and a fourth end portion configured to be supported by the first wheel capture endplate.

In one or more embodiments, a method includes providing the second base end portion with a plurality of first mounting holes, and providing the first wheel capture endplate with a plurality of second mounting holes, wherein each of the plurality of first mounting holes is associated with a respective one of the plurality of second mounting holes, and the second wheel capture arm is configured to be removably supported by a selected one of the plurality of first mounting holes and the respective one of the plurality of second mounting holes.

In one or more embodiments, a method includes providing the first base end portion with a plurality of third mounting holes; and providing the first wheel capture endplate with a plurality of fourth mounting holes, wherein, each of the plurality of third mounting holes is associated with a respective one of the plurality of fourth mounting holes, and the first wheel capture arm is configured to be removably supported by a selected one of the plurality of third mounting holes and the respective one of the plurality of fourth mounting holes.

In one or more embodiments, providing the second wheel capture arm includes movably supporting a second outer support arm with the central support bar, and operably connecting a second middle portion of a second wheel capture base with the second outer support arm, the first middle portion located between a first and a second base end portion of the second wheel capture base.

In one or more embodiments, a method includes configuring the first and second wheel capture base such that when the first and second wheel capture bases are positioned on a floor, the central support arm is elevated above the floor by a distance which is greater than a minimum height of a jack arm of a floor jack such that the jack arm of the floor jack can be inserted beneath the central support arm without raising the central support arm.

In one or more embodiments, configuring the first and second wheel capture base includes configuring the first and second wheel capture base such that when the first and second wheel capture bases are positioned on the floor, the central support arm is elevated above the floor by a distance of about 3.5 inches.

In one or more embodiments, a method includes providing a coupling mechanism configured to removably couple at least one jack stand to at least one of the central support arm and the first outer support arm.

In one or more embodiments, a method includes providing the at least one jack stand.

In one or more embodiments, providing the at least one jack stand includes providing at least one ratcheting jack stand.

BRIEF DESCRIPTION OF THE DRAWINGS

The accompanying drawings illustrate various embodiments of the present disclosure and together with a description serve to explain the principles of the disclosure.

FIG. 2 depicts a side plan view of the vehicle lift adapter system of FIG. 1;

FIG. 3 depicts a top plan view of the vehicle lift adapter system of FIG. 1;

FIG. 4 depicts a side plan view of a wheel capture base of the vehicle lift adapter system of FIG. 1; and FIG. 5 depicts a perspective view of the vehicle lift adapter system of FIG. 1 including floor stands and coupling mechanisms.

Corresponding reference characters indicate corresponding parts throughout the several views. Like reference characters indicate like parts throughout the several views.

DETAIL DESCRIPTION OF THE DISCLOSURE

Figure 1:
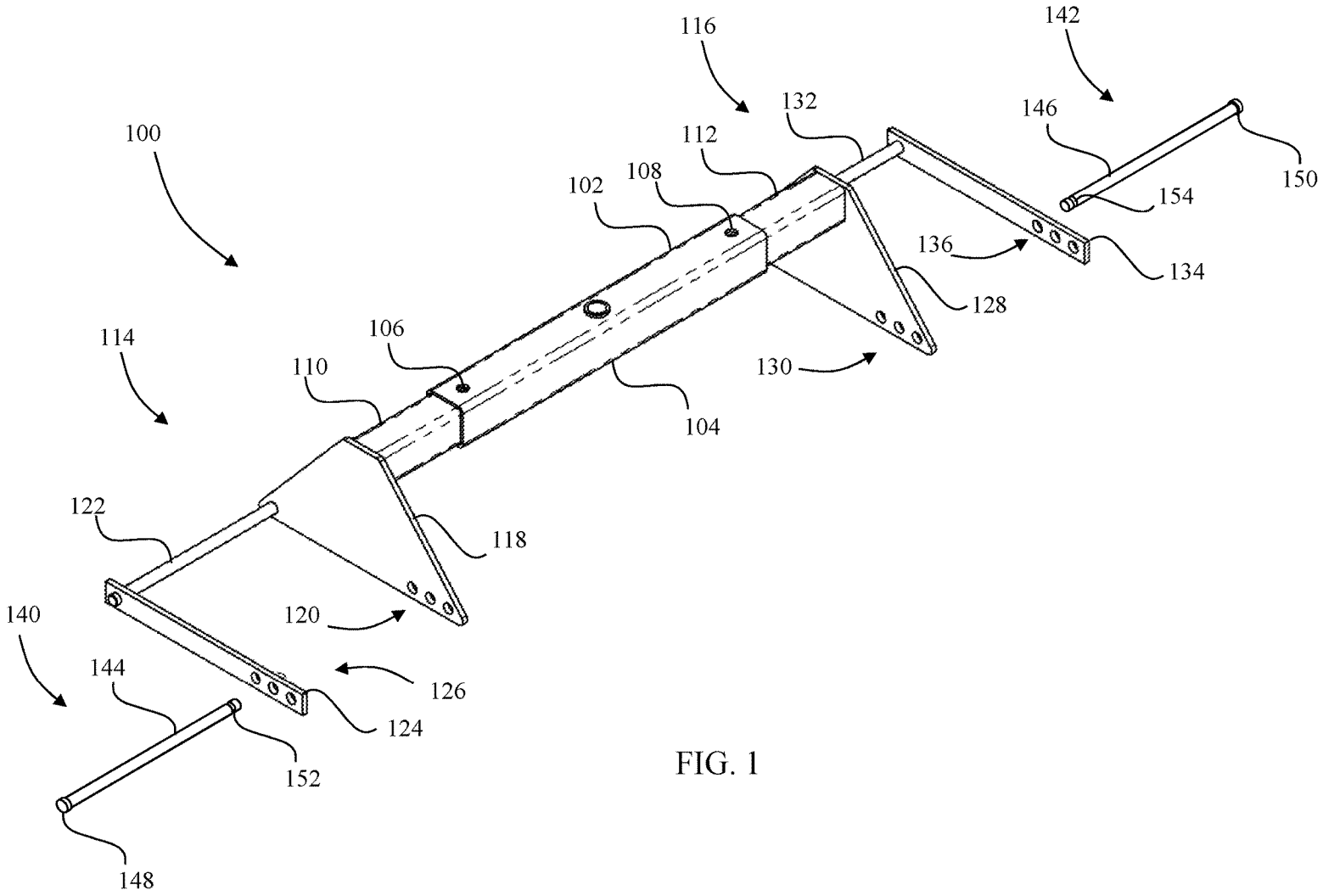
FIG. 1 depicts a perspective view of a vehicle lift adapter system.

While the systems and processes described herein are susceptible to various modifications and alternative forms, specific embodiments thereof have been shown by way of example in the drawings and will herein be described in detail. It should be understood, however, that there is no intent to limit the systems and processes to the particular forms disclosed. On the contrary, the disclosure is to cover all modifications, equivalents, and alternatives falling within the spirit and scope of the disclosure.

FIG. 1 depicts a vehicle lift adapter system 100. The vehicle lift adapter system 100 includes a central support bar 102 which includes a mounting portion 104 and two bores 106/108 which extend through the outer wall of the central support bar 102. The system 100 further includes two outer support arms 110/112 which in one embodiment are movably supported by the central support bar 100. Specifically, the outer support arms 110/112 are sized to fit within a cavity defined by the outer wall of the central support bar 102.

The outer support arms 110/112 support wheel capture assemblies 114/116, respectively. The wheel capture assembly 114 includes a wheel capture base 118 which is rigidly supported by the outer support arm 110 although in some embodiments the mounting is pivotable. The wheel capture base 118 includes three mounting holes 120 at one end portion of the wheel capture base 118 although in some embodiments more or fewer holes are provided. At the opposite end portion, the wheel capture base 118 supports a wheel capture arm 122 which in some embodiments is removable. The wheel capture arm 122 supports an end plate 124. The end plate 124 includes a plurality of mounting holes 126, each of the mounting holes 126 associated with (aligned or alignable with) a respective one of the mounting holes 120.

The wheel capture assembly 116 includes a wheel capture base 128 which is rigidly supported by the outer support arm 112 although in some embodiments the mounting is pivotable. The wheel capture base 128 includes three mounting holes 130 at one end portion of the wheel capture base 128 although in some embodiments more or fewer holes are provided. At the opposite end portion, the wheel capture base 128 supports a wheel capture arm 132 which in some embodiments is removable. The wheel capture arm 132 supports an end plate 134. The end plate 134 includes a plurality of mounting holes 136, each of the mounting holes 136 associated with (aligned or alignable with) a respective one of the mounting holes 130.

The vehicle lift adapter system of FIG. 1 further includes wheel capture arms 140 and 142. The wheel capture arms 140 and 142 include shafts 144/146 which are sized to extend through the mounting holes 120/124/130/136 and head portions 148/150 which are not sized to pass through the mounting holes 120/124/130/136. On the shafts 144/146 a respective groove 152/154 is formed. The grooves 152/154 are positioned such that when the wheel capture arms 140/142 are inserted through a respective pair of the mounting holes 120/124/130/136, the grooves will be accessible either inwardly of the respective base plate or outwardly of the respecting end plate.

In operation, the wheel capture arms 140/142 are removed from the mounting holes 120/124/130/136 and the vehicle lift adapter system 100 is positioned such that two wheels of a vehicle positioned adjacent to the wheel capture arms 122/132 within the space defined by the wheel capture arms 122/132, the endplate 124, and the wheel capture bases 118/128. In the embodiment of FIG. 1, the outer support arms are movable. Accordingly, the outer support arms are adjusted such that the wheel capture bases 118/128 are positioned directly inwardly of two wheels. In some embodiments, a rod is then positioned through the bores 106/108 into bores (not shown) in the outer support arms to secure the outer support arms.

Preferably, the foregoing adjustment results in the mounting portion 104 being located directly in the middle of the wheel capture bases 118/128. In some embodiments, the outer support arms are moved by a rack and pinion system to ensure equal extension. In other embodiments, the outer support arms are marked to assist in properly extending the outer support arms. In further embodiments, the outer support arms are fixedly attached. For fixed outer support arms, the wheel capture assemblies may be adjustable to account for varying wheel axis lengths.

In embodiments wherein the wheel capture arms 122/132 are removable, the wheel capture bases 118/128 are positioned directly inwardly of two wheels, and the wheel capture arms 122/132 and, if provided, the endplates 124/134 are connected to the wheel capture arms 122/132 if not already attached. In some embodiments, a plurality of mounting holes are provided at both of the end portions of the wheel capture bases. This allows the wheels to be more precisely centered on the wheel capture assemblies.

Once the wheels of a vehicle are positioned adjacent to the wheel capture arms 122/132, the wheel capture arms 140/142 are inserted through pairs of the mounting holes 120/124/130/136 such that the grooves 152/154 are accessible either inwardly of the respective base plate or outwardly of the respecting end plate. An R-clip or the like is then used to prevent unintended removal of the wheel capture arms 140/142. In some embodiments, a hole is provided in place of the grooves, and a cotter pin is used. This ensures that the weight carried by each of the wheel capture assemblies is substantially centered on the central support bar 102 as discussed further below.

Next, a floor jack, if not already positioned, is positioned beneath the mounting portion 104. In order to facilitate positioning of the floor jack, the wheel capture bases 118/128 are configured to suspend the central support bar 102 at a height 144 (see FIG. 2) which allows a floor jack to be positioned beneath and aligned with the mounting portion 104. In some embodiments, the height 144 is selected to be about 3.5 inches, which is a common height of commercially available floor jacks. In further embodiments, the height is selected to accommodate a differently sized floor jack.

The floor jack is then operated to elevate the wheels of the vehicle. Specifically, as the floor jack is elevated the wheel capture arms entrain the wheels of the vehicle. Contact of the wheels with the wheel capture arms will cause a self-centering of the wheels between the two wheel capture arms.

As noted above, the configuration of the end portions/mounting holes of the wheel capture bases is such that the weight borne by the wheel capture assemblies is substantially centered on the central support bar 102. As used herein, the term "centered on the central support bar" means that the midpoint of a line extending directly from one of the wheel capture arms to another of the wheel capture arms in a wheel capture assembly is directly beneath the longitudinal axis of the central support bar. Thus, the weight vector of a weight borne by the wheel capture assembly is aligned with the longitudinal axis.

For example, FIG. 3 depicts a top plan view of the vehicle lift adapter system 100 showing the longitudinal axis 160 of the central support bar 102 which is collinear with the longitudinal axis of the outer support arms. The wheel capture bases 118/128 extend outwardly from the longitudinal axis 160 by an equal amount.

Turning now to FIG. 4, the midpoint of a line 164 between the outermost mounting hole 130 and the wheel capture arm 132 has a midpoint at the origin of the vector 166 which is aligned with the longitudinal axis 162 as evidenced by the dashed line 168. In FIG. 4, some of the mounting holes 130 are positioned such that the weight borne by the wheels is not precisely centered with the longitudinal axis. For example, mounting in any hole other than the far left mounting hole 130 will shift the weight vector 166 slightly away from the line 168.

For embodiments wherein the weight of the vehicle would create an undesired amount of torque on the floor jack even with only a substantial centering of the weight as provided by the inner mounting holes 130, more precise alignment of the weight with the longitudinal axis may be provided. For example, some embodiments provide addition holes to the right (as depicted in FIG. 4) of the wheel capture base 128 along with a removable wheel capture arm 132. Other embodiments provide for a rotatable supporting connection between the wheel capture bases and the outer support arms such as by a bolt centered on the longitudinal axis 160.

With reference now to FIG. 5, once the wheels have been sufficiently elevated, floor stands 170/172 may be positioned beneath the vehicle lift adapter system 100. The floor stands 170/172, which in this embodiment are ratcheting type floor stands, in one embodiment are provided as a part of the vehicle lift adapter system 100. The central support bar 102 and or the outer support arms 110/112 in some embodiments are marked to indicate to a user the proper positioning of the floor stands 170/172. In the embodiment of FIG. 2, the outer support arms 110/112 include recessed areas 174/176 which are configured to receive the floor stands 170/172.

Returning to FIG. 5, the vehicle lift adapter system 100 further includes coupling mechanisms 178 (only one is shown) used to couple the floor stands 170/172 to the central support bar 102 and or the outer support arms 110/112. Accordingly, as the floor jack continues to elevate the wheels, the floor stands 170/172 ratchet outwardly. Accordingly, even if the floor jack fails while further elevating the wheels, the floor stands will prevent the vehicle from falling to the floor.

Consequently, once the vehicle has been elevated to the desired height, the floor jack may be removed and the floor stands 170/172 will hold the vehicle safely. In embodiments without ratcheting floor stands, the height of the floor stands is set once the vehicle is elevated to the desired height. Lowering of the vehicle occurs in substantially the reverse process with the exception that the floor jack is first used to remove weight from the floor stands and the floor stands are removed before lowering of the vehicle.

The above described vehicle lift adapter system is manufactured by first determining a desired load and safety factor. Once the desired load and safety factor are determined, an appropriate material for the various components is selected which will provide the desired strength. A central support bar is then configured to be removably mounted on a jack arm of a floor jack. In some embodiments, this entails structurally augmenting the mounting portion 104. In some embodiments, a coupling is provided which allows for the floor jack to couple with the mounting portion 104.

Next, the outer support arms are connected to the central support bar, either fixedly or movably. As noted above, holes may be bored into both the central support bar 102 and the outer support arms to provide for temporarily fixing the position of the outer support arms with respect to the central support bar.

The method further includes attaching a wheel capture assembly to one or more of the outer support arms. In embodiments with only one wheel capture assembly, the opposite outer support arm may be provided with a forked extension which is used to capture one wheel while the wheel capture assembly is used to capture the other wheel. The wheel capture assembly is attached to the outer support arm using either a fixed mounting arrangement with a wheel capture base or a rotatable mounting arrangement with the wheel capture base. In either embodiment, the connection is made at a middle portion of the wheel capture base.

The wheel capture base is provided with at least one mounting hole to receive a removable wheel capture arm. In some embodiments, both of the wheel capture arms are configured to be removable. End plates are optionally provided to provide additional structural support for the wheel capture arms. In some embodiments, the end plate is fixedly attached to one of the wheel capture arms.

The vehicle lift adapter system preferably includes coupling mechanisms 178 which can be provided in the form of a strap or a band. In embodiments which further include one or more floor stands, a coupling mechanism unique to the particular floor stand may be provided.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

The invention claimed is:

1. A vehicle lift adapter system, comprising:

a central support bar defining a longitudinal axis and including a mounting portion configured to be removably mounted on a jack arm of a floor jack;

a first outer support arm configured to be supported by the central support bar;

a second outer support arm configured to be supported by the central support bar;

said central support bar, first outer support arm and second outer support arm being co-linear;

a first wheel capture base including a first middle portion located between a first end portion and a second end portion and operably connected to the first outer support arm;

a first wheel capture arm configured to be supported by the first end portion;

a second wheel capture arm configured to be supported by the second end portion, wherein the first end portion and the second end portion are arranged such that a weight applied to the first wheel capture arm and the second wheel capture arm is substantially centered on the longitudinal axis; and a second wheel capture base including a second middle portion located between a third end portion and a fourth end portion and operably connected to the second outer support arm, wherein the first and second wheel capture bases are configured such that when the first and second wheel capture bases are positioned on a floor, the central support bar arm is supported by the first and second wheel capture bases above the floor by a distance which is greater than a minimum height of a jack arm of a floor jack such that the jack arm of the floor jack can be inserted beneath the central support bar arm without further elevating the central support bar.

2. The vehicle lift adapter system of claim 1, wherein the first outer support arm is movably supported by the central support bar.

3. The vehicle lift adapter system of claim 2, further comprising a first wheel capture endplate, wherein:

a first end portion of the first wheel capture arm is configured to be supported by the first base end portion;

a second end portion of the first wheel capture arm is configured to be supported by the first wheel capture endplate;

a third end portion of the second wheel capture arm is configured to be supported by the second base end portion; and a fourth end portion of the second wheel capture arm is configured to be supported by the first wheel capture endplate.

4. The vehicle lift adapter system of claim 3, wherein:

the second base end portion includes a plurality of first mounting holes;

the first wheel capture endplate includes a plurality of second mounting holes;

each of the plurality of first mounting holes is associated with a respective one of the plurality of second mounting holes; and the second wheel capture arm is configured to be removably supported by a selected one of the plurality of first mounting holes and the respective one of the plurality of second mounting holes.

5. The vehicle lift adapter system of claim 4, wherein:

the first base end portion includes a plurality of third mounting holes;

the first wheel capture endplate includes a plurality of fourth mounting holes;

each of the plurality of third mounting holes is associated with a respective one of the plurality of fourth mounting holes; and the first wheel capture arm is configured to be removably supported by a selected one of the plurality of third mounting holes and the respective one of the plurality of fourth mounting holes.

6. The vehicle lift adapter system of claim 3, further comprising:

a third wheel capture arm configured to be supported by the third end portion;

a fourth wheel capture arm configured to be supported by the fourth end portion; and a second wheel capture endplate, wherein:

a fifth end portion of the third wheel capture arm is configured to be supported by the third base end portion;

a sixth end portion of the third wheel capture arm is configured to be supported by the second wheel capture endplate;

a seventh end portion of the fourth wheel capture arm is configured to be supported by the fourth base end portion; and an eighth end portion of the fourth wheel capture arm is configured to be supported by the second wheel capture endplate.

7. The vehicle lift adapter system of claim 6, further comprising:

at least one coupling mechanism configured to removably couple at least one jack stand to at least one of the central support bar and the first outer support arm, the at least one coupling mechanism spaced apart from the mounting portion along the longitudinal axis.

8. The vehicle lift adapter system of claim 7, further comprising:

the at least one jack stand.

9. The vehicle lift adapter system of claim 8, wherein the at least one jack stand is a ratcheting jack stand.

10. The vehicle lift adapter system of claim 1, wherein the first and second wheel capture bases are configured such that when the first and second wheel capture base are positioned on the floor, the central support bar is elevated above the floor by a distance of about 3.5 inches.

11. The vehicle lift adapter system of claim 1, wherein:

the first wheel capture base is rotatably connected to the first outer support arm; and the second wheel capture base is rotatably connected to the second outer support arm.

12. A method of making a vehicle lift adapter system, comprising:

configuring a mounting portion of a central support bar to be removably mounted on a jack arm of a floor jack;

coupling a first outer support arm with the central support bar;

coupling a second outer support arm with the central support bar;

said central support bar, first outer support arm and second outer support arm being co-linear;

operably connecting a first middle portion of a first wheel capture base to the first outer support arm, the first middle portion located between a first and a second base end portion;

supporting a first wheel capture arm with the first end portion; and providing a second wheel capture arm configured to be supported by the second end portion, wherein the first end portion and the second end portion are arranged such that a weight applied to the first wheel capture arm and the second wheel capture arm is substantially centered on a longitudinal axis defined by the central support bar; and operably connecting a second middle portion of a second wheel capture base to the second outer support arm, the second middle portion located between a third and a fourth base end portion, wherein the first and second wheel capture bases are configured such that when the first and second wheel capture bases are positioned on a floor, the central support bar is supported by the first and second wheel capture bases above the floor by a distance which is greater than a minimum height of a jack arm of a floor jack such that the jack arm of the floor jack can be inserted beneath the central support bar without further elevating the central support bar.

13. The method of claim 12, wherein coupling the first outer support arm with the central support bar comprises:

movably coupling a first outer support arm with the central support bar.

14. The method of claim 13, wherein supporting the first wheel capture arm comprises supporting a first end portion of the first wheel capture arm with the first base end portion, the method further comprising:

supporting a first wheel capture endplate with a second end portion of the first wheel capture arm, wherein the second wheel capture arm includes a third end portion configured to be supported by the second base end portion, and a fourth end portion configured to be supported by the first wheel capture endplate.

15. The method of claim 14, further comprising:

providing the second base end portion with a plurality of first mounting holes; and providing the first wheel capture endplate with a plurality of second mounting holes, wherein each of the plurality of first mounting holes is associated with a respective one of the plurality of second mounting holes; and the second wheel capture arm is configured to be removably supported by a selected one of the plurality of first mounting holes and the respective one of the plurality of second mounting holes.

16. The method of claim 15, further comprising:

providing the first base end portion with a plurality of third mounting holes; and providing the first wheel capture endplate with a plurality of fourth mounting holes, wherein:

each of the plurality of third mounting holes is associated with a respective one of the plurality of fourth mounting holes; and the first wheel capture arm is configured to be removably supported by a selected one of the plurality of third mounting holes and the respective one of the plurality of fourth mounting holes.

17. The method of claim 14, wherein configuring the first and second wheel capture base comprises:

configuring the first and second wheel capture base such that when the first and second wheel capture bases are positioned on the floor, the central support bar is elevated above the floor by a distance of about 3.5 inches.

18. The method of claim 14, further comprising:

providing at least one coupling mechanism configured to removably couple at least one jack stand to at least one of the central support bar and the first outer support arm, the at least one coupling mechanism spaced apart from the mounting portion along the longitudinal axis.

19. The method of claim 12, wherein:

operably connecting the first middle portion of the first wheel capture base to the first outer support arm includes rotatably connecting the first middle portion of the first wheel capture base to the first outer support arm; and operably connecting the second middle portion of the second wheel capture base to the second outer support arm includes rotatably connecting the second middle portion of the second wheel capture base to the second outer support arm.

* * * * *